US006216856B1

(12) United States Patent
Park

(10) Patent No.: US 6,216,856 B1
(45) Date of Patent: Apr. 17, 2001

(54) HOLDER FOR ASSORTED DESK ARTICLES

(76) Inventor: Hong Ku Park, 203 Southcrest Dr., Huntsville, AL (US) 35802

( * ) Notice: Subject to any disclaimer, the term of this patent is extended or adjusted under 35 U.S.C. 154(b) by 0 days.

(21) Appl. No.: 09/460,474

(22) Filed: Dec. 14, 1999

(51) Int. Cl.[7] ..... A47G 29/00

(52) U.S. Cl. ..... 206/214; 40/722; 206/371; 206/457

(58) Field of Search ..... 40/720, 722; 206/214, 206/217, 224, 371, 457; 215/6, 12.1; 220/23.91, 62.12, 737–741; 229/400, 402, 403

(56) References Cited

U.S. PATENT DOCUMENTS

| | | | | |
|---|---|---|---|---|
| D. 204,687 | | 5/1966 | Bieger . | |
| D. 226,359 | | 2/1973 | Leedy . | |
| D. 308,076 | | 5/1990 | Gecchelin . | |
| D. 323,352 | | 1/1992 | Halm . | |
| D. 323,853 | | 2/1992 | Evenson . | |
| D. 364,189 | | 11/1995 | Trombly . | |
| D. 367,408 | | 2/1996 | Fordyce . | |
| D. 381,044 | | 7/1997 | Larm . | |
| D. 398,649 | | 9/1998 | Ricci . | |
| D. 407,211 | | 3/1999 | Diviak, Sr. . | |
| D. 414,809 | | 10/1999 | Trombly . | |
| 4,001,959 | * | 1/1977 | Grendahl | 40/722 |
| 4,195,729 | * | 4/1980 | Macken | 40/720 |
| 4,979,325 | * | 12/1990 | White | 40/720 |
| 5,040,719 | * | 8/1991 | Ballway | 215/12.1 |
| 5,099,998 | * | 3/1992 | Curzon et al. | 215/12.1 |
| 5,593,053 | * | 1/1997 | Kaufman | 215/12.1 |
| 5,894,948 | * | 4/1999 | Yeh | 215/12.1 |
| 6,065,609 | * | 5/2000 | Lake | 206/217 |

* cited by examiner

*Primary Examiner*—Jim Foster
(74) *Attorney, Agent, or Firm*—Waddey & Patterson, PC; John C. Garvin, Jr.

(57) ABSTRACT

A holder for assorted desktop articles such as pens, pencils, scissors, rulers, and the like. The holder comprises an annular top member, a cup-shaped container, a cylindrical sleeve, an annular base member, and a separate pen holder.

10 Claims, 4 Drawing Sheets

HOLDER FOR ASSORTED DESK ARTICLES

FIELD OF THE INVENTION

This invention relates generally to a holder for assorted desktop articles, and more particularly to such a holder which can accommodate a variety of articles such as pens, pencils, scissors, rulers, highlighters, and the like.

BACKGROUND OF THE INVENTION

Many desktops are cluttered with various items that lay unorganized and hard to locate by users. Many people use articles such as a coffee cup, a drinking glass, or a tray to avoid the cluttered appearance of the desktop.

There are also several known U.S. patents which disclose prior art desktop holders or caddies for housing desktop items. These patents include U.S. Pat. No. Des. 204,687 to Bieger; U.S. Pat. No. Des. 308,076 to Gecchelin; U.S. Pat. No. Des. 323,352 to Halm; U.S. Pat. No. Des. 323,853 to Evenson; U.S. Pat. No. Des. 364,189 to Trombly; U.S. Pat. No. Des. 367,408 to Fordyce; U.S. Pat. No. Des. 381,044 to Larm; U.S. Pat. No. Des. 398,649 to Ricci; U.S. Pat. No. Des. 407,211 to Diviak Sr.; and U.S. Pat. No. Des. 414,809 to Trombly. Each of these design patents relate to the ornamental design for a holder for writing instruments and the like. While these prior art holders might be utilized to hold an assortment of desktop articles, all suffer from numerous deficiencies and disadvantages. The present invention overcomes these deficiencies and disadvantages in that it provides a new and improved desktop holder that fills the need for a simple inexpensive holder made from readily available materials and permits the display of photographs of loved ones on the desktop.

SUMMARY OF THE INVENTION

The holder for assorted desktop items of the present invention generally comprises an annular top member, a cup-shaped container, a cylindrical sleeve, an annular base member, and a separate pen holder. The items intended to be held by the desktop holder of the present invention include pens, pencils, scissors, highlighters, and the like.

It is an object of the present invention to provide a new and improved desktop holder which may be easily and efficiently manufactured from inexpensive and readily available materials and parts.

It is a further object of the present invention to provide a new and improved holder for an assortment of items such as pencils, pens, scissors, rulers, and the like which permits the items to be readily accessible and not clutter the desktop.

It is yet a further object of the present invention to provide a new and improved desktop holder for housing a variety of desktop items and which can be easily manufactured and made from readily available components and can also serve to display photographs of loved ones on the desktop.

Other objects, features, and advantages of the present invention will become apparent from the following detailed description and from the appended drawings in which like numbers have been used to designate like parts throughout the several views.

DESCRIPTION OF THE PREFERRED EMBODIMENTS

Figure 1:
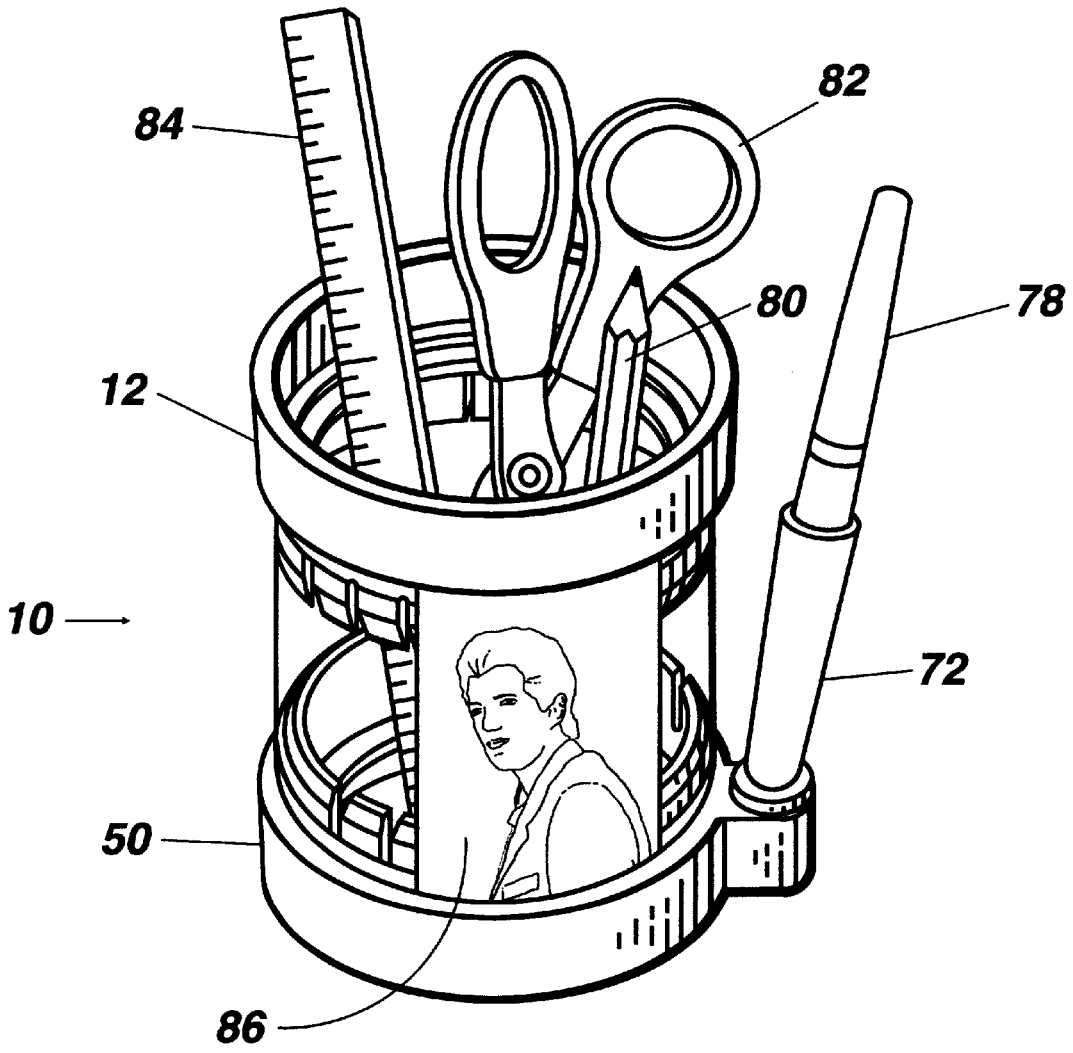
FIG. 1 is a perspective view of the preferred embodiment of the desktop holder of the present invention having an assortment of instruments therein and displaying a photograph of a loved one.
Figure 2:
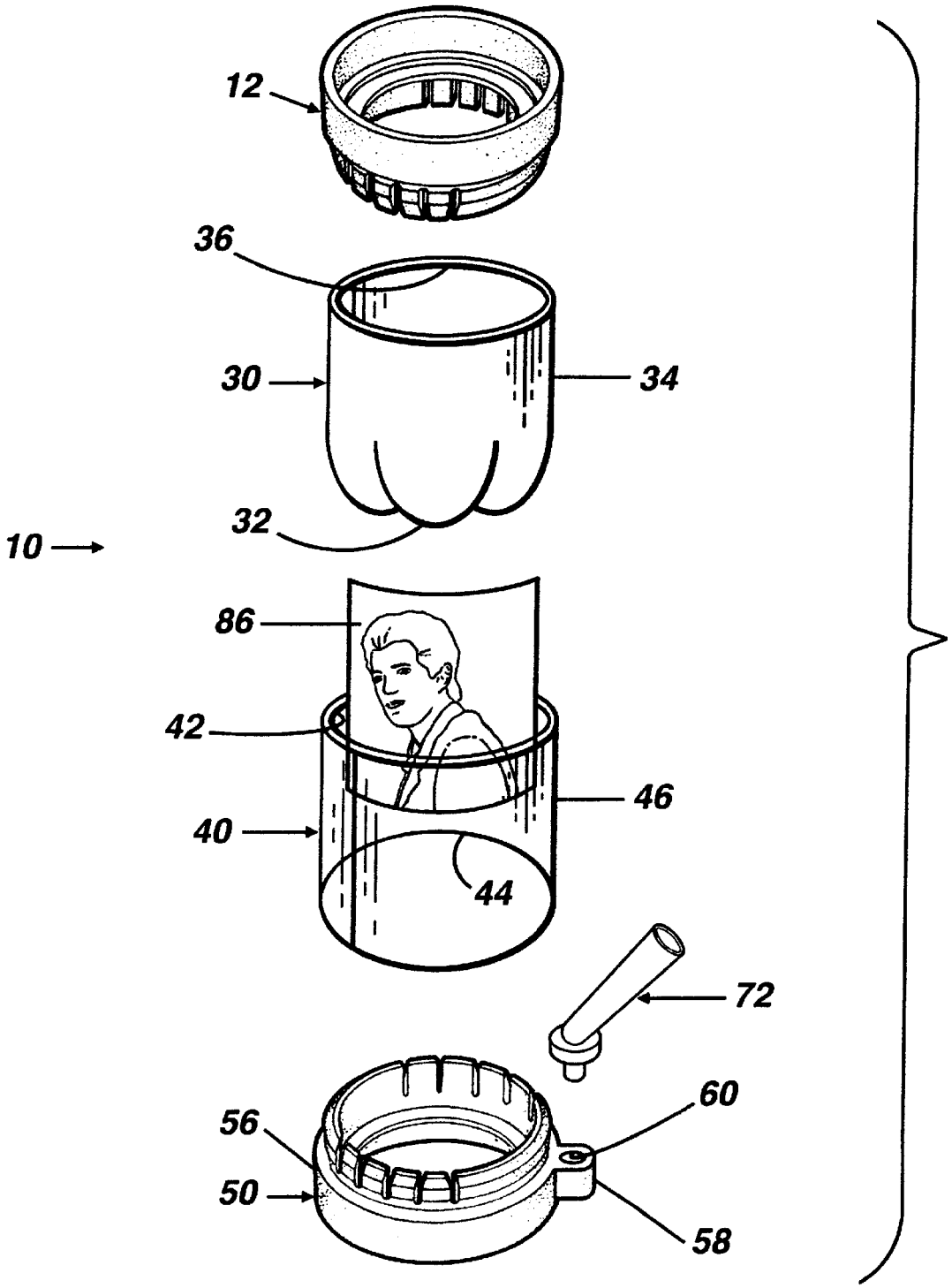
FIG. 2 is an exploded perspective view of the preferred embodiment of the desktop holder of the present invention.
Figure 3:
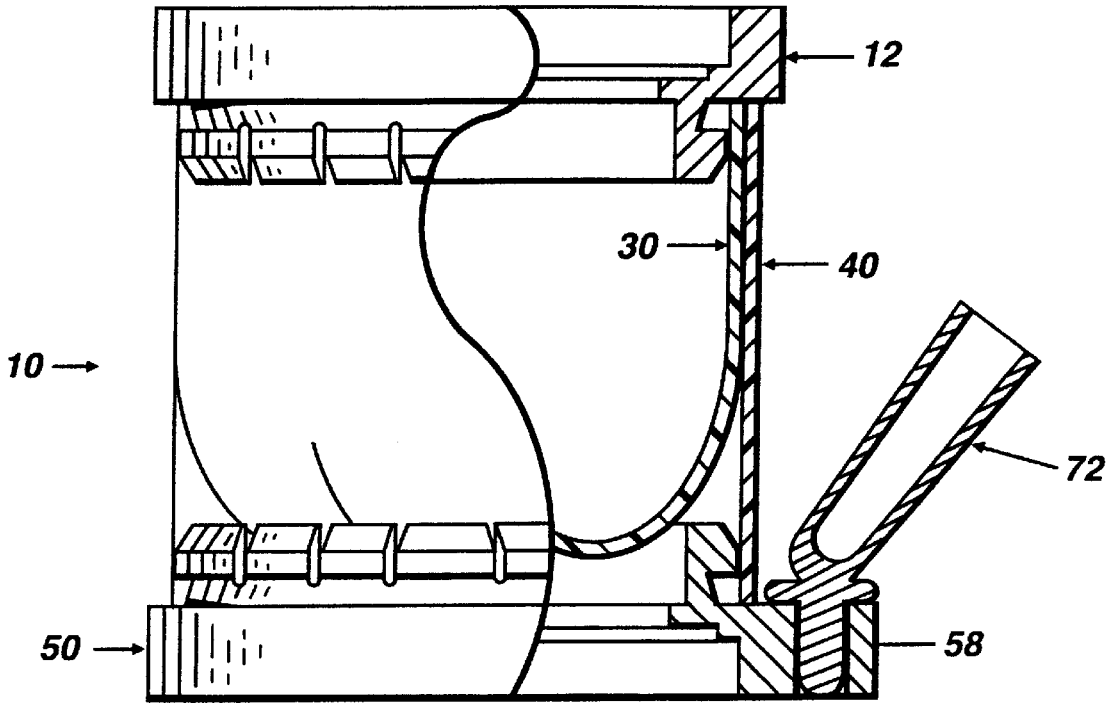
FIG. 3 is a front elevational, partially broken away, and crosssectional, view of the preferred embodiment of the desktop holder of the present invention.
Figure 4:
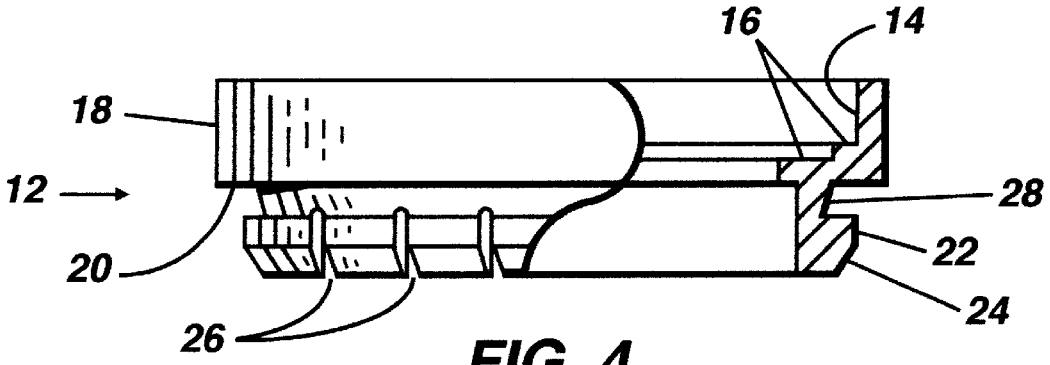
FIG. 4 is a front elevational, partially cross-sectional, view of the annular top member used in the present invention.
Figure 5:
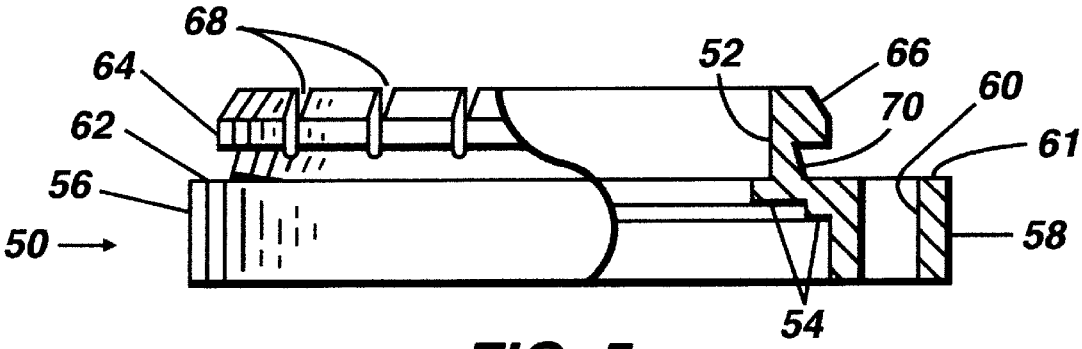
FIG. 5 is a front elevational, partially cross-sectional, view of the generally annular base member used in the present invention.
Figure 6:
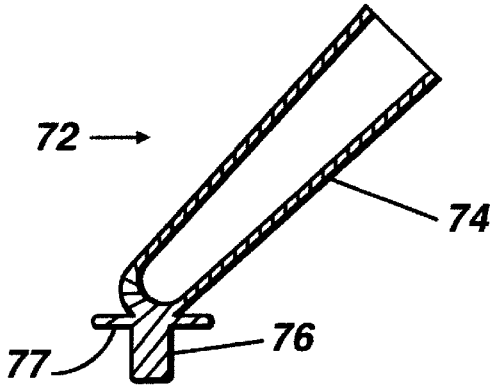
FIG. 6 is a front elevational, cross-sectional, view of a pen holder used in the present invention.

Referring now to the drawings, wherein like numerals represent like parts throughout, reference numeral 10 generally designates the desktop holder of the present invention. As best seen in FIGS. 1–3, desktop holder 10 generally comprises an annular top member 12, a cup-shaped container 30, a sleeve 40, an annular base member 50, and an individual pen holder 72. As best seen in FIG. 4, annular top member 12 includes as central opening 14; two internal annular shoulders 16; an upper annular portion 18; an external annular shoulder 20; a lower annular portion 22 having a tapered section 24 and a plurality of slits 26; and an external annular groove 28. As best seen in FIG. 2, cup-shaped container 30 includes a closed bottom 32, a side wall 34, and an upper opening 36. As further best seen in FIG. 2, sleeve 40 is shown as hollow, transparent, and cylindrical, and includes an upper opening 42; a bottom opening 44; and a side wall 46. As best seen in FIGS. 2 and 5, annular base member 50 includes a central opening 52; two internal annular shoulders 54; a lower annular portion 56 having a projection 58 with a central opening 60 therein; a shoulder 61 surrounding the upper portion of opening 60; an external annular shoulder 62; an upper annular portion 64 having a tapered section 66 and a plurality of slits 68; and an external annular groove 70. Individual pen holder 72 includes a cup-shaped tapered socket 74; a pin member 76 for insertion in the central opening 60 in projection 58 of lower annular portion 56 of annular base member 50, and an annular flange 77 for engaging shoulder 61. As best seen in FIG. 1, a plurality of articles normally found on a desktop is shown housed in holder 10. These articles include pens 78, pencils 80, scissors 82, and a ruler 84. Further, as best seen in FIGS. 1 and 2, a photograph 86 of a loved one may be placed within the gap (not numbered) between cup-shaped container 30 and the transparent cylindrical sleeve 40 to be displayed in the desktop holder 10.

The holder 10 might be assembled by inserting the bottom opening 44 of sleeve 40 over the upper annular portion 64 of annular base member 50 to a point where the walls of the bottom opening 44 engage shoulder 62 such that the upper annular portion 64 secures the sleeve 40 to the annular base member 50 due to the frictional fit between the walls of the bottom opening 44 of sleeve 40 with the surface of the upper annular portion 64 of annular base member 50. The slits 68 make the upper annular portion 64 somewhat flexible. One or more photographs 86 may then be placed on the outside of annular portion 64 and the inner wall of sleeve 40 to be held by annular portion 64. The lower annular portion 22 of annular top member 12 might then be inserted within the upper opening 36 of cup-shaped container 30 to a point where the walls of the upper opening 36 engage the shoulder

20 to secure the cup-shaped container 30 to the annular top member 12 due to the frictional fit between the internal walls adjacent the upper opening 36 of cup-shaped container 30 and the lower annular portion 22 of annular top member 12. The slits 26 make the lower annular portion 22 somewhat flexible. The assembled annular top member 12 and the cup-shaped container 30 can next be inserted within the assembled sleeve 40 and annular base member 50 until the upper edge of upper opening 42 of sleeve 40 engages the external annular shoulder 20 of annular top member 12. The pin member 76 is next inserted in the central opening 60 in projection 58 of lower annular portion 56 of annular base member 50 with the bottom of flange 77 engaging the shoulder 61. After the holder 10 is assembled as generally explained, articles such as pens 78, pencils 80, scissors 82, and rulers 84 can be placed within the cup-shaped container 30 and the tapered socket 74 of pen holder 72.

The foregoing is provided for purposes of illustration, explanation, and description of the preferred embodiment of the present invention. Modifications, variations and adaptations of the preferred embodiment will be apparent to those of ordinary skill in the art and they may be made without departing from the scope or spirit of the invention. For example, the individual pen holder 72 could be mounted within an opening in a projection which extends from top annular member 12 in lieu of annular base member 50. Still further, the shape of numerous parts (e.g., the top member 12 and the base member 50) could be something other than annular, e.g., square. It is preferred that the cup-shaped container 30 and the sleeve 40 be made of a transparent plastic material, but it is apparent that they could be made of other suitable materials. It is further apparent that holder 10 can be used for holding flowers and the like in lieu of items such as pens, pencils, scissors, etc.

Thus, although there have been described a particular embodiment of the present invention of a new and useful HOLDER FOR ASSORTED DESK ARTICLES, it is not intended that such references be construed as limitations upon the scope of this invention except as set forth in the following claims.

What is claimed is:

1. A holder for one or more selected items, said holder comprising:

a hollow top member including a central opening therethrough, an upper portion, a lower portion, and an external shoulder;

a cup-shaped container including a closed bottom, a side wall, a cavity, and an upper opening in communication with said cavity of said cup-shaped container and said central opening of said hollow top member, said upper opening in said cup-shaped container disposed for receiving said lower portion of said top member for securing said cup-shaped container to said top member;

a hollow sleeve including an upper opening, a side wall and a lower opening, said hollow sleeve surrounding said side wall of said cup-shaped container and providing a gap therebetween; and a base member including an upper portion, an external shoulder, and a lower portion for receiving said lower opening of said hollow sleeve for securing said hollow sleeve to said base member.

2. The holder of claim 1 wherein said top member and its said lower portion and said external shoulder, and said base member and its said upper portion and said external shoulder are annular.

3. The holder of claim 2 wherein said hollow sleeve is cylindrical.

4. The holder of claim 1 wherein said hollow sleeve is transparent and said gap between said hollow sleeve and said cup-shaped container is adapted to receive one or more photographs for display within the holder.

5. The holder of claim 1 further including an individual pen compartment having an opened socket, an annular flange and a protruding pin.

6. The holder of claim 5 wherein said lower portion of said base member includes a projection with an opening therein for receiving said protruding pen of said individual pen compartment.

7. A holder for one or more of selected items, said holder comprising:

a top member including a central opening, an upper portion, a lower portion having a plurality of slits therein, and an external shoulder;

a cup-shaped container for housing said one or more selected items, said cup-shaped container including a closed bottom, a side wall, and an upper opening for receiving said lower portion of said top member;

a hollow sleeve including an upper opening, a side wall, and a lower opening, said hollow sleeve surrounding said side wall of said container and providing a gap therebetween; and a base member including an upper portion having a plurality of slits therein, an external shoulder, and a lower portion for receiving said lower opening of said hollow sleeve for securing said hollow sleeve to said base member.

8. The holder of claim 7 wherein said top member and said base member are annular.

9. The holder of claim 8 wherein said hollow sleeve is cylindrical.

10. The holder of claim 9 wherein said hollow sleeve is transparent and said gap between said hollow sleeve and said cup-shaped container is adapted for receiving one or more photographs for display.

* * * * *